US010885823B2

(12) United States Patent
Kim

(10) Patent No.: US 10,885,823 B2
(45) Date of Patent: Jan. 5, 2021

(54) DISPLAY APPARATUS AND A METHOD OF DRIVING A DISPLAY PANEL USING THE SAME

(71) Applicant: SAMSUNG DISPLAY CO., LTD., Yongin-si (KR)

(72) Inventor: Wontae Kim, Hwaseong-si (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 0 days.

(21) Appl. No.: 16/401,154

(22) Filed: May 2, 2019

(65) Prior Publication Data

US 2019/0347972 A1 Nov. 14, 2019

(30) Foreign Application Priority Data

May 8, 2018 (KR) ..... 10-2018-0052809

(51) Int. Cl.
*G09G 3/20* (2006.01)

(52) U.S. Cl.
CPC ..... *G09G 3/20* (2013.01); *G09G 2310/0291* (2013.01); *G09G 2310/08* (2013.01)

(58) Field of Classification Search
CPC ..... G09G 3/20; G09G 2310/0291; G09G 2310/08
See application file for complete search history.

(56) References Cited

U.S. PATENT DOCUMENTS

| | | | | |
|---|---|---|---|---|
| 9,508,305 | B2 * | 11/2016 | Uemura | G09G 3/3614 |
| 10,354,602 | B2 * | 7/2019 | Hwang | G09G 3/3677 |
| 2015/0243239 | A1 * | 8/2015 | Uemura | G09G 3/3614 345/209 |
| 2018/0033381 | A1 * | 2/2018 | Hwang | G09G 3/3607 |
| 2018/0374447 | A1 * | 12/2018 | Yun | G09G 3/00 |

FOREIGN PATENT DOCUMENTS

| | | |
|---|---|---|
| KR | 10-2013-0111013 | 1/2013 |
| KR | 10-2016-0087484 | 7/2016 |
| KR | 10-2017-0002776 | 1/2017 |
| KR | 10-2017-0126568 | 11/2017 |

OTHER PUBLICATIONS

Kim et al., "P-16: A New Driving Method to Compensate for Row Line Signal Propagation Delays in an AMLCD", SID 04 Digest, 2004, pp. 280-283.

* cited by examiner

*Primary Examiner* — Peter D McLoone
(74) *Attorney, Agent, or Firm* — F. Chau & Associates, LLC

(57) ABSTRACT

A display apparatus includes a display panel, a gate driver and a data driver. The display panel is configured to display an image. The gate driver is configured to output gate signals to the display panel. The data driver includes positive amplifiers configured to output positive data voltages to the display panel and negative amplifiers configured to output negative data voltages to the display panel. A driving timing of the positive amplifiers and a driving timing of the negative amplifiers are independently controlled.

17 Claims, 12 Drawing Sheets

DISPLAY APPARATUS AND A METHOD OF DRIVING A DISPLAY PANEL USING THE SAME

CROSS-REFERENCE TO RELATED APPLICATION

This application claims priority under 35 U.S.C. § 119 to Korean Patent Application No. 10-2018-0052809, filed on May 8, 2018 in the Korean Intellectual Property Office (KIPO), the disclosure of which is incorporated by reference herein in its entirety.

TECHNICAL FIELD

Exemplary embodiments of the present inventive concept relate to a display apparatus and a method of driving a display panel using the display apparatus.

DESCRIPTION OF THE RELATED ART

Generally, a display apparatus includes a display panel and a display panel driver. The display panel includes a plurality of gate lines, a plurality of data lines and a plurality of pixels. The display panel driver includes a gate driver, a data driver and a driving controller. The gate driver outputs gate signals to the gate lines under control of the driving controller. The data driver outputs data voltages to the data lines under control of the driving controller.

As the size of the display panel has increased, a gate signal applied to an area of the display panel far from the gate driver is delayed. In this case, a data voltage may not be charged to the pixel at the area of the display panel far from the gate driver.

SUMMARY

In an exemplary embodiment of the present inventive concept, a display apparatus includes a display panel, a first gate driver and a data driver. The display panel is configured to display an image. The first gate driver is configured to output gate signals to the display panel. The data driver includes positive amplifiers configured to output positive data voltages to the display panel and negative amplifiers configured to output negative data voltages to the display panel. A driving timing of the positive amplifiers and a driving timing of the negative amplifiers are independently controlled.

In an exemplary embodiment of the present inventive concept, the display panel may include a first area having a first distance from the first gate driver and a second area having a second distance from the first gate driver, wherein the second distance is greater than the first distance. The data driver may include a first positive amplifier configured to output a first positive data voltage to the second area and a first negative amplifier configured to output a first negative data voltage to the second area, wherein the first negative amplifier is adjacent to the first positive amplifier. A data output timing of the first negative amplifier may be later than a data output timing of the first positive amplifier.

In an exemplary embodiment of the present inventive concept, the data driver may further include a second positive amplifier configured to output a second positive data voltage to the first area and a second negative amplifier configured to output a second negative data voltage to the first area, wherein the second negative amplifier is adjacent to the second positive amplifier. A time difference of the data output timing of the first negative amplifier and the data output timing of the first positive amplifier may be greater than a time difference of a data output timing of the second negative amplifier and a data output timing of the second positive amplifier.

In an exemplary embodiment of the present inventive concept, a first dock signal may be applied to the positive amplifiers. A second clock signal may be applied to the negative amplifiers.

In an exemplary embodiment of the present inventive concept, a first period of the first clock signal to drive the positive amplifiers corresponding to the first area may be less than a second period of the first clock signal to drive the positive amplifiers corresponding to the second area.

In an exemplary embodiment of the present inventive concept, a third period of the second clock signal to drive the negative amplifiers corresponding to the first area may be less than a fourth period of the second clock signal to drive the negative amplifiers corresponding to the second area.

In an exemplary embodiment of the present inventive concept, the fourth period of the second dock signal to drive the negative amplifiers corresponding to the second area may be greater than the second period of the first clock signal to drive the positive amplifiers corresponding to the second area.

In an exemplary embodiment of the present inventive concept, a plurality of positive multiphase clock signals having phases different with each other may be generated based on a first clock signal. The positive multiphase clock signals may be sequentially applied to the positive amplifiers.

In an exemplary embodiment of the present inventive concept, a plurality of negative multiphase clock signals having phases different with each other may be generated based on a second clock signal. The negative multiphase clock signals may be sequentially applied to the negative amplifiers.

In an exemplary embodiment of the present inventive concept, the first gate driver may be disposed adjacent to a first side of the display panel. The first area may be adjacent to the first side of the display panel. The second area may be adjacent to a second side of the display panel facing the first side of the display panel.

In an exemplary embodiment of the present inventive concept, the display apparatus may further include a second gate driver configured to output the gate signals to the display panel. The first gate driver may be disposed adjacent to a first side of the display panel and the second gate driver is disposed adjacent to a second side of the display panel facing the first side of the display panel. The first area may be adjacent to the first side of the display panel or the second side of the display panel. The second area may correspond to a central portion of the display panel.

In an exemplary embodiment of the present inventive concept, a method of driving a display panel includes outputting gate signals to the display panel, outputting positive data voltages to the display panel using positive amplifiers and outputting negative data voltages to the display panel using negative amplifiers. A driving timing of the positive amplifiers and a driving timing of the negative amplifiers are independently controlled.

In an exemplary embodiment of the present inventive concept, the display panel may include a first area having a first distance from a gate driver and a second area having a second distance from the gate driver, wherein the second distance is greater than the first distance. A data driver may include a first positive amplifier configured to output a first positive data voltage to the second area and a first negative amplifier configured to output a first negative data voltage to the second area, wherein the first negative amplifier is adjacent to the first positive amplifier. A data output timing of the first negative amplifier may be later than a data output timing of the first positive amplifier.

In an exemplary embodiment of the present inventive concept, the data driver may further include a second positive amplifier configured to output a second positive data voltage to the first area and a second negative amplifier configured to output a second negative data voltage to the first area, wherein the second negative amplifier is adjacent to the second positive amplifier. A time difference of the data output timing of the first negative amplifier and the data output timing of the first positive amplifier may be greater than a time difference of a data output timing of the second negative amplifier and a data output timing of the second positive amplifier.

In an exemplary embodiment of the present inventive concept, a first clock signal may be applied to the positive amplifiers. A second clock signal may be applied to the negative amplifiers.

In an exemplary embodiment of the present inventive concept, a first period of the first clock signal to drive the positive amplifiers corresponding to the first area may be less than a second period of the first clock signal to drive the positive amplifiers corresponding to the second area.

In an exemplary embodiment of the present inventive concept, a third period of the second clock signal to drive the negative amplifiers corresponding to the first area may be less than a fourth period of the second clock signal to drive the negative amplifiers corresponding to the second area.

In an exemplary embodiment of the present inventive concept, the fourth period of the second clock signal to drive the negative amplifiers corresponding to the second area may be greater than the second period of the first clock signal to drive the positive amplifiers corresponding to the second area.

In an exemplary embodiment of the present inventive concept, a display apparatus includes: a display panel configured to display an image; a gate driver configured to output gate signals to the display panel; and a data driver comprising a first amplifier configured to output a first data voltage to the display panel and a second amplifier configured to output a second data voltage to the display panel, wherein a driving time of the first amplifier and a driving time of the second amplifier are independently controlled.

In an exemplary embodiment of the present inventive concept, a falling time and a rising time of the second data voltage is delayed with respect to a falling time and a rising time of the first data voltage such that the first gate signal does not overlap the falling time of the first data voltage and the rising time of the second data voltage.

In an exemplary embodiment of the present inventive concept, a plurality of pixels are arranged in a horizontal row in the display panel, and a gate signal applied to a pixel farthest from the gate driver is delayed with respect to a gate signal applied to a pixel closest to the gate driver.

BRIEF DESCRIPTION OF THE DRAWINGS

The above and other features of the present inventive concept will become more apparent by describing in detail exemplary embodiments thereof with reference to the accompanying drawings, in which.

DETAILED DESCRIPTION OF THE EMBODIMENTS

Hereinafter, exemplary embodiments of the present inventive concept will be explained in detail with reference to the accompanying drawings.

Figure 1:
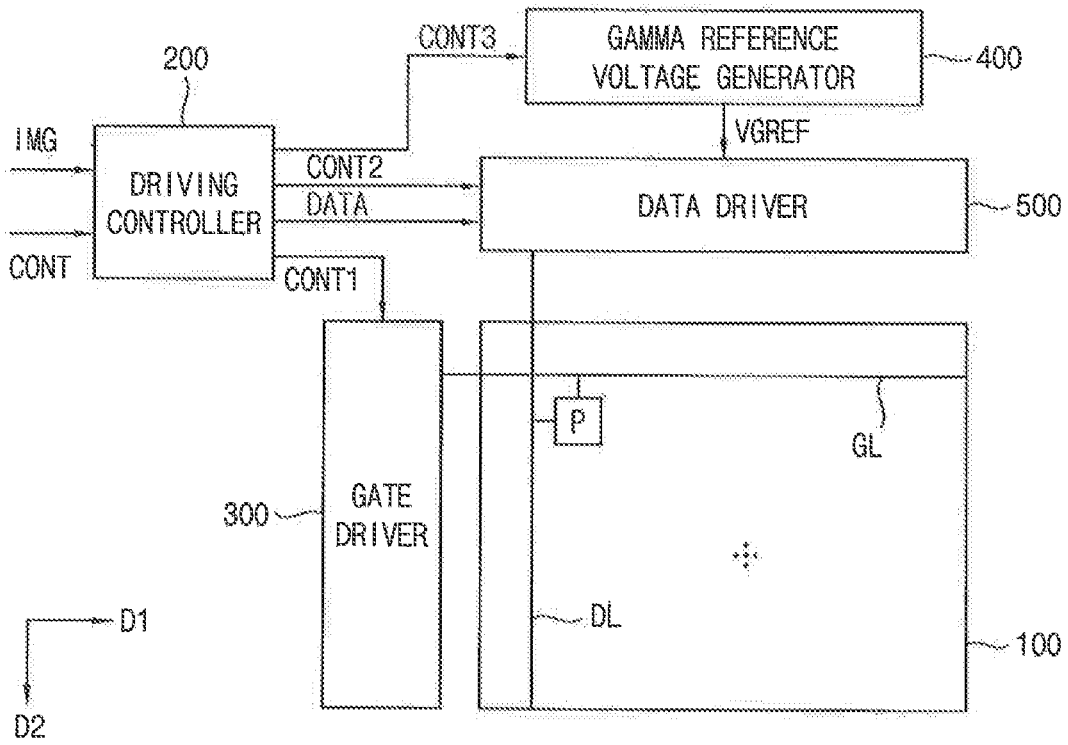
FIG. 1 is a block diagram illustrating a display apparatus according to an exemplary embodiment of the present inventive concept.

FIG. 1 is a block diagram illustrating a display apparatus according to an exemplary embodiment of the present inventive concept.

Referring to FIG. 1, the display apparatus includes a display panel 100 and a display panel driver. The display panel driver includes a driving controller 200, a gate driver 300, a gamma reference voltage generator 400 and a data driver 500.

The display panel 100 includes a display region and a peripheral region adjacent to the display region.

The display panel 100 includes a plurality of gate lines GL, a plurality of data lines DL and a plurality of pixels P electrically connected to the gate lines GL and the data lines DL. The gate lines GL extend in a first direction D1 and the data lines DL extend in a second direction D2 crossing the first direction D1.

The driving controller 200 receives input image data IMG and an input control signal CONT from an external apparatus. The input image data IMG may include red image data, green image data and blue image data. The input image data IMG may include white image data. The input image data IMG may include magenta image data, yellow image data and cyan image data. The input control signal CONT may include a master clock signal and a data enable signal. The input control signal CONT may further include a vertical synchronizing signal and a horizontal synchronizing signal.

The driving controller 200 generates a first control signal CONT1, a second control signal CONT2, a third control signal CONT3 and a data signal DATA based on the input image data IMG and the input control signal CONT.

The driving controller 200 generates the first control signal CONT1 for controlling an operation of the gate driver 300 based on the input control signal CONT, and outputs the first control signal CONT1 to the gate driver 300. The first control signal CONT1 may include a vertical start signal and a gate clock signal. In other words, the gate driver 300 may be provided with a vertical start signal and a gate clock signal.

The driving controller 200 generates the second control signal CONT2 for controlling an operation of the data driver 500 based on the input control signal CONT, and outputs the second control signal CONT2 to the data driver 500. The second control signal CONT2 may include a horizontal start signal and a load signal. In other words, the data driver 500 may be provided with a horizontal start signal and a load signal.

The driving controller 200 generates the data signal DATA based on the input image data IMG. The driving controller 200 outputs the data signal DATA to the data driver 500.

The driving controller 200 generates the third control signal CONT3 for controlling an operation of the gamma reference voltage generator 400 based on the input control signal CONT, and outputs the third control signal CONT3 to the gamma reference voltage generator 400.

The gate driver 300 generates gate signals for driving the gate lines GL in response to the first control signal CONT1, received from the driving controller 200. For example, the gate driver 300 may sequentially output the gate signals to the gate lines GL.

The gamma reference voltage generator 400 generates a gamma reference voltage VGREF in response to the third control signal CONT3 received from the driving controller 200. The gamma reference voltage generator 400 provides the gamma reference voltage VGREF to the data driver 500. The gamma reference voltage VGREF has a value corresponding to a level of the data signal DATA.

In an exemplary embodiment of the present inventive concept, the gamma reference voltage generator 400 may be disposed in the driving controller 200, or in the data driver 500.

The data driver 500 receives the second control signal CONT2 and the data signal DATA from the driving controller 200, and receives the gamma reference voltage VGREF from the gamma reference voltage generator 400. The data driver 500 converts the data signal DATA into data voltages having an analog form using the gamma reference voltage VGREF. The data driver 500 outputs the data voltages to the data lines DL.

Figure 2:
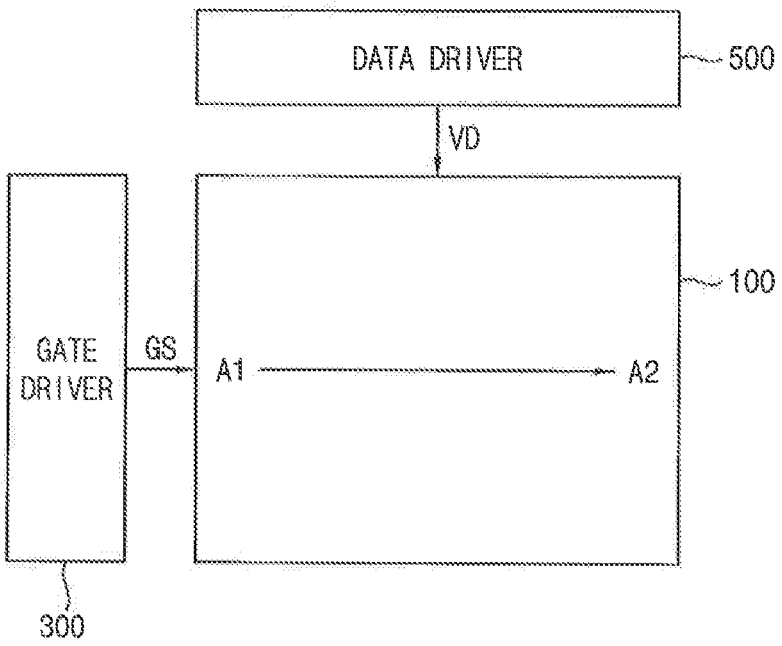
FIG. 2 is a diagram illustrating a gate driver, a data driver and a display panel of FIG. 1 according to an exemplary embodiment of the present inventive concept.
Figure 3:
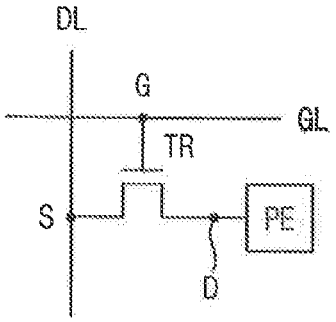
FIG. 3 is a circuit diagram illustrating a pixel of FIG. 1 according to an exemplary embodiment of the present inventive concept.
Figure 4A:
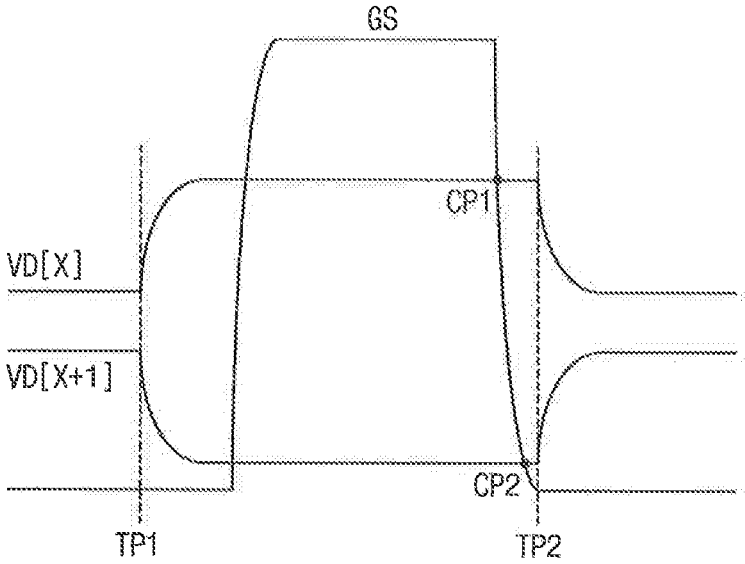
FIG. 4A is a waveform diagram illustrating a positive data voltage output from a positive amplifier corresponding to a first area of FIG. 2 and a negative data voltage output from a negative amplifier corresponding to the first area of FIG. 2 according to a comparative embodiment.
Figure 4B:
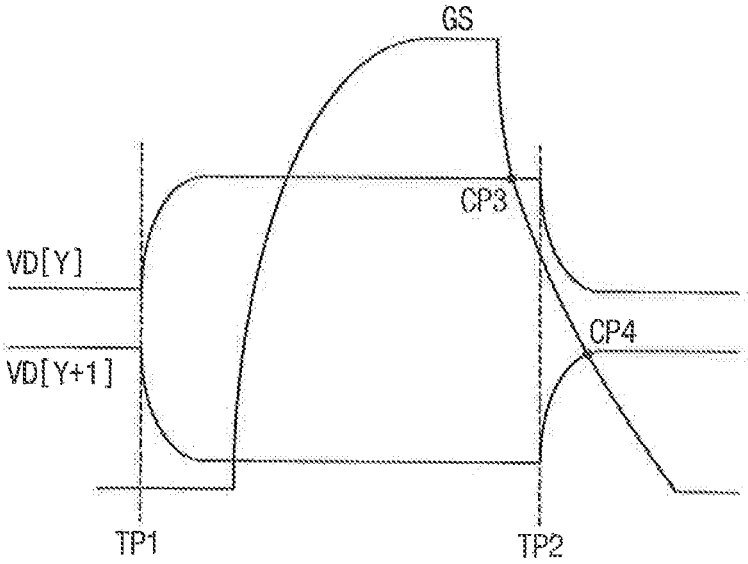
FIG. 4B is a waveform diagram illustrating a positive data voltage output from a positive amplifier corresponding to a second area of FIG. 2 and a negative data voltage output from a negative amplifier corresponding to the second area of FIG. 2 according to a comparative embodiment.

FIG. 2 is a diagram illustrating the gate driver 300, the data driver 500 and the display panel 100 of FIG. 1. FIG. 3 is a circuit diagram illustrating the pixel P of FIG. 1. FIG. 4A is a waveform diagram illustrating a positive data voltage output from a positive amplifier corresponding to a first area A1 of FIG. 2 and a negative data voltage output from a negative amplifier corresponding to the first area A1 of FIG. 2 according to a comparative embodiment. FIG. 4B is a waveform diagram illustrating a positive data voltage output from a positive amplifier corresponding to a second area A2 of FIG. 2 and a negative data voltage output from a negative amplifier corresponding to the second area A2 of FIG. 2 according to a comparative embodiment.

Referring to FIGS. 1 and 2, the gate driver 300 outputs a gate signal GS to the display panel 100. The data driver 500 outputs a data voltage VD to the display panel 100.

In the present exemplary embodiment, the gate driver 300 is disposed adjacent to a first side of the display panel 100. The display panel 100 includes a first area A1 close to the gate driver 300 and a second area A2 far from the gate driver 300. A waveform of the gate signal GS outputted from the gate driver 300 may be delayed in the second area A2 compared to the first area A1. In other words, the gate signal GS may reach the second area A2 after it reaches the first area A1.

Referring to FIG. 3, the pixel P may include a switching element TR connected to the gate line GL and the data line DL and a pixel electrode PE connected to the switching element TR. For example, a gate electrode G of the switching element TR may be connected to the gate line GL, a source electrode S of the switching element TR may be connected to the data line. DL and a drain electrode D of the switching element TR may be connected to the pixel electrode PE.

In the comparative embodiment of FIGS. 4A and 4B, the positive amplifier and the negative amplifier output the data voltage simultaneously.

Referring to FIG. 4A, the gate signal GS may not be delayed in the first area A1 close to the gate driver 300. For example, VD[X] represents the data voltage outputted front the positive amplifier corresponding to the first area A1 and VD[X+1] represents the data voltage outputted from the negative amplifier corresponding to the first area A1. The negative amplifier corresponding to the first area A1 may be adjacent to the positive amplifier corresponding to the first area A1. In a first time point TP1, the positive data voltage VD[X] may rise toward a corresponding target grayscale and the negative data voltage VD[X+1] may fall toward a corresponding target grayscale. In a second time point TP2, the positive data voltage VD[X] may rise or fall toward a corresponding target grayscale of a next horizontal line and the negative data voltage VD[X+1] may rise or fall toward a corresponding target grayscale of the next horizontal line.

In FIG. 4A, the waveform of the gate signal GS is illustrated to overlap with the positive and negative data voltages VD[X] and VD[X+1]. The gate signal GS is applied to the gate electrode G of the pixel P and the positive and negative data voltages VD[X] and VD[X+1] are applied to the source electrode S of the pixel P so that a crossing point CP1 and CP2 of the waveform of the gate signal GS and the waveforms of the positive and negative data voltages VD[X] and VD[X+1] may approximately correspond to a turn-off time of the switching element TR of the pixel P.

In FIG. 4A, the gate signal GS may not be delayed and the gate signal GS is overlapped with the positive data voltage VD[X] at a first crossing point CP1. Thus, a positive pixel to which the positive data voltage VD[X] is applied may represent a desired target grayscale. The gate signal GS is overlapped with the negative data voltage VD[X+1] at a second crossing point CP2. Thus, a negative pixel to which the negative data voltage VD[X+1] is applied may represent a desired target grayscale.

Referring to FIG. 4B, the gate signal GS may be delayed in the second area A2 far from to the gate driver 300. For example, a falling waveform of the gate signal GS may be delayed more than a rising waveform of the gate signal GS. For example, VD[Y] represents the data voltage outputted from the positive amplifier corresponding to the second area A2 and VD[Y+1] represents the data voltage outputted from the negative amplifier corresponding to the second area A2. The negative amplifier corresponding to the second area A2 may be adjacent to the positive amplifier corresponding to the second area A2. In a first time point TP1, the positive data voltage VD[Y] may rise toward a corresponding target grayscale and the negative data voltage VD[Y+1] may fall toward a corresponding target grayscale. In a second time point TP2, the positive data voltage VD[Y] may rise or fall toward a corresponding target grayscale of a next horizontal line and the negative data voltage VD[Y+1] may rise or fall toward a corresponding target grayscale of the next horizontal line.

In FIG. 4B, the waveform of the gate signal GS is illustrated to overlap with the positive and negative data voltages VD[Y] and VD[Y+1]. The gate signal GS is applied to the gate electrode G of the pixel P and the positive and negative data voltages VD[Y] and VD[Y+1] are applied to the source electrode S of the pixel P so that a crossing point CP3 and CP4 of the waveform of the gate signal GS and the waveforms of the positive and negative data voltages VD[Y] and VD[Y+1] may approximately correspond to a turn-off time of the switching element TR of the pixel P.

In FIG. 4B, the gate signal GS may be delayed. For example, the falling waveform of the gate signal GS may be delayed more than the rising waveform of the gate signal GS. In other words, the waveform of the gate signal GS may drop slower than it rises. The gate signal GS is overlapped with the positive data voltage VD[Y] at a third crossing point CP3. Thus, a positive pixel to which the positive data voltage VD[Y] is applied may represent a desired target grayscale. The gate signal GS is overlapped with the negative data voltage VD[Y+1] at a fourth crossing point CP4. However, the fourth crossing point CP4 corresponds to a high level of the negative data voltage VD[Y+1]. Thus, a negative pixel to which the negative data voltage VD[Y+1] is applied may not represent a desired target grayscale due to the delay of the gate signal GS.

Figure 5A:
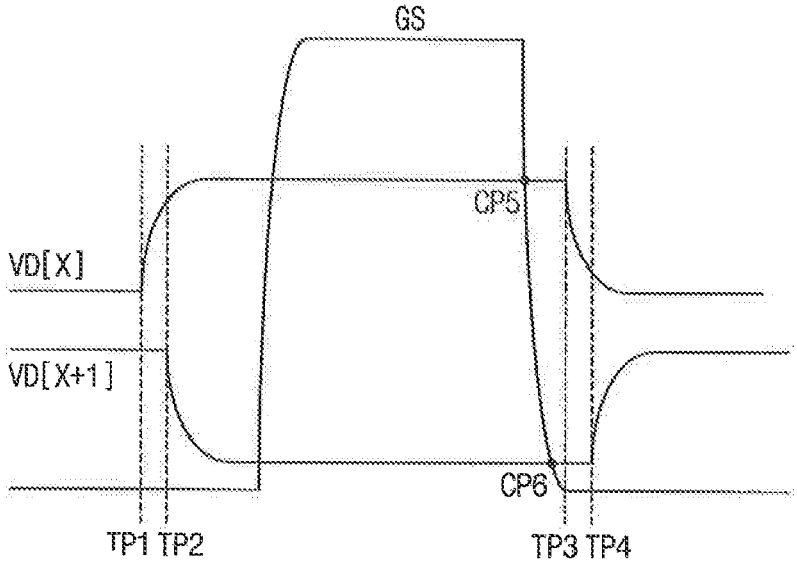
FIG. 5A is a waveform diagram illustrating a positive data voltage output from a positive amplifier corresponding to the first area of FIG. 2 and a negative data voltage output from a negative amplifier corresponding to the first area of FIG. 2 according to an exemplary embodiment of the present inventive concept.
Figure 5B:
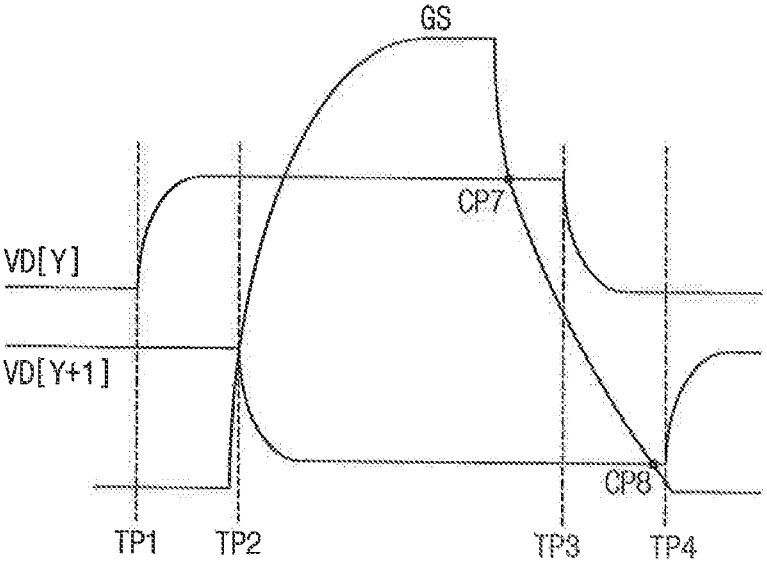
FIG. 5B is a waveform diagram illustrating a positive data voltage output from a positive amplifier corresponding to the second area of FIG. 2 and a negative data voltage output from a negative amplifier corresponding to the second area of FIG. 2 according to an exemplary embodiment of the present inventive concept.

FIG. 5A is a waveform diagram illustrating a positive data voltage output from the positive amplifier corresponding to the first area A1 of FIG. 2 and a negative data voltage output from the negative amplifier corresponding to the first area A1 of FIG. 2 according to an exemplary embodiment of the present inventive concept. FIG. 5B is a waveform diagram illustrating a positive data voltage output from the positive amplifier corresponding to the second area A2 of FIG. 2 and a negative data voltage output from the negative amplifier corresponding to the second area A2 of FIG. 2 according to an exemplary embodiment of the present inventive concept.

In the present exemplary embodiment of FIGS. 5A and 5B, the positive amplifier and the negative amplifier may output the data voltage non-simultaneously. In the present exemplary embodiment, the driving timing of the positive amplifiers and the driving timing of the negative amplifiers may also be independently controlled. For example, the data output timing of a first negative amplifier may be later than the data output timing of a first positive amplifier adjacent to the first negative amplifier.

Referring to FIG. 5A, the gate signal GS may not be delayed in the first area A1 close to the gate driver 300. For example, VD[X] represents the data voltage outputted from the positive amplifier corresponding to the first area A1 and VD[X+1] represents the data voltage outputted from the negative amplifier corresponding to the first area A1. The negative amplifier corresponding to the first area A1 may be adjacent to the positive amplifier corresponding to the first area A1. In a first time point TP1, the positive data voltage VD[X] may rise toward a corresponding target grayscale. In a second time point TP2 delayed with respect to the first time point TP1, the negative data voltage VD[X+1] may fall toward a corresponding target grayscale. In a third time point TP3, the positive data voltage VD[X] may rise or fall toward a corresponding target grayscale of a next horizontal line. In a fourth time point TP4 delayed with respect to the third time point TP3, the negative data voltage VD[X+1] may rise or fall toward a corresponding target grayscale of the next horizontal line.

In FIG. 5A, the waveform of the gate signal GS is illustrated to overlap with the positive and negative data voltages VD[X] and VD[X+1]. The gate signal GS is applied to the gate electrode G of the pixel P and the positive and negative data voltages VD[X] and VD[X+1] are applied to the source electrode S of the pixel P so that a crossing point CP5 and CP6 of the waveform of the gate signal GS and the waveforms of the positive and negative data voltages VD[X] and VD[X+1] may approximately correspond to a turn-off time of the switching element TR of the pixel P.

In FIG. 5A, the gate signal GS may not be delayed, and thus, the gate signal GS is overlapped with the positive data voltage VD[X] at a fifth crossing point CP5. Thus, a positive pixel to which the positive data voltage VD[X] is applied may represent a desired target grayscale. In addition, the gate signal GS is overlapped with the delayed negative data voltage VD[X+1] at a sixth crossing point CP6. Thus, a negative pixel to which the negative data voltage VD[X+1] is applied may represent a desired target grayscale.

Referring to FIG. 5B, the gate signal GS may be delayed in the second area A2 far from the gate driver 300. For example, a falling waveform of the gate signal GS may be delayed more than a rising waveform of the gate signal GS. For example, VD[Y] represents the data voltage outputted from the positive amplifier corresponding to the second area A2 and VD[Y+1] represents the data voltage outputted from the negative amplifier corresponding to the second area A2. The negative amplifier corresponding to the second area A2 may be adjacent to the positive amplifier corresponding to the second area A2. In a first time point TP1, the positive data voltage VD[Y] may rise toward a corresponding target grayscale. In a second time point TP2 delayed with respect to the first time point TP1, the negative data voltage VD[Y+1] may fall toward a corresponding target grayscale. In a third time point TP3, the positive data voltage VD[Y] may rise or fall toward a corresponding target grayscale of a next horizontal line. In a fourth time point TP4 delayed with respect to the third time point TP3, the negative data voltage VD[Y+1] may rise or fall toward a corresponding target grayscale of the next horizontal line. A difference between the second time point TP2 and the first time point TP1 in FIG. 5B may be greater than a difference between the second time point TP2 and the first time point TP1 in FIG. 5A since the delay of the gate signal GS in the second area A2 is greater than the delay of the gate signal GS in the first area A1.

In FIG. 5B, the waveform of the gate signal GS is illustrated to overlap with the positive and negative data voltages VD[Y] and VD[Y+1]. The gate signal GS is applied to the gate electrode G of the pixel P and the positive and negative data voltages VD[Y] and VD[Y+1] are applied to the source electrode S of the pixel P so that a crossing point CP7 and CP8 of the waveform of the gate signal GS and the waveforms of the positive and negative data voltages VD[Y] and VD[Y+1] may approximately correspond to a turn off time of the switching element TR of the pixel P.

In FIG. 5B, the gate signal GS may be delayed. For example, the falling waveform of the gate signal GS may be delayed more than the rising waveform of the gate signal GS. The gate signal GS is overlapped with the positive data voltage VD[Y] at a seventh crossing point CP7. Thus, a positive pixel to which the positive data voltage VD[Y] is applied may represent a desired target grayscale. The gate signal GS is overlapped with the delayed negative data voltage VD[Y+1] at an eighth crossing point CP8. The falling timing and the rising timing of the delayed negative data voltage VD[Y+1] is delayed with respect to the falling timing and the rising timing of the positive data voltage VD[Y] to compensate for the delay of the gate signal GS so that a negative pixel to which the negative data voltage VD[Y+1] is applied can represent a desired target grayscale.

As shown in FIG. 5B, the data output timing (TP2 in FIG. 5B) of the negative amplifier corresponding to the second area A2 may be later than the data output timing (TP1 in FIG. 5B) of the positive amplifier corresponding to the second area A2. The positive amplifier adjacent to the negative amplifier corresponding to the second area A2 may be a previous amplifier of the negative amplifier corresponding to the second area A2 or a next amplifier of the negative amplifier corresponding to the second area A2.

As shown in FIG. 5A, the data output timing (TP2 in FIG. 5A) of the negative amplifier corresponding to the first area A1 may be later than the data output timing (TP1 in FIG. 5) of the positive amplifier corresponding to the first area A1. The positive amplifier adjacent to the negative amplifier corresponding to the first area A1 may be a previous amplifier of the negative amplifier corresponding to the first area A1 or a next amplifier of the negative amplifier corresponding to the first area A1. The delay of the gate signal GS in the first area A1 is small so that the data output timing (TP2 in FIG. 5A) of the negative amplifier corresponding to the first area A1 may be set to be almost same as the data output timing (TP1 in FIG. 5A) of the positive amplifier corresponding to the first area A1.

In addition, the delay of the gate signal GS in the second area A2 is greater than the delay of the gate signal GS in the first area A1 so that the difference (e.g., TP2-TP1 in FIG. 5B) of the data output timing of the negative amplifier corresponding to the second area A2 and the data output timing of the positive amplifier corresponding to the second area A2 may be greater than the difference (e.g., TP2-TP1 in FIG. 5) of the data output timing of the negative amplifier corresponding to the first area A1 and the data output timing of the positive amplifier corresponding to the first area A1.

Figure 6:
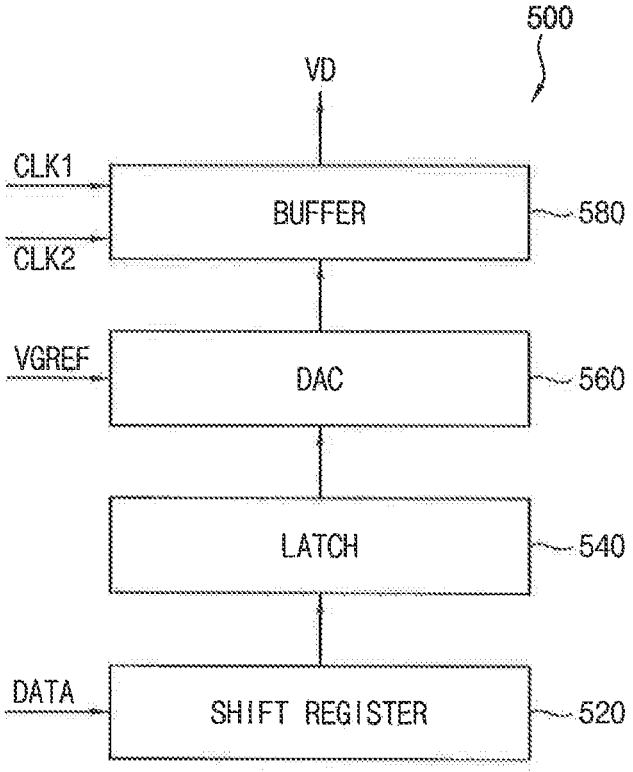
FIG. 6 is a block diagram illustrating the data driver of FIG. 1 according to an exemplary embodiment of the present inventive concept.

FIG. 6 is a block diagram illustrating the data driver 500 of FIG. 1, according to an exemplary embodiment of the present inventive concept.

Referring to FIGS. 1 to 6, the data driver 500 includes a shift register 520, a latch 540, a digital-to-analog converter (DAC) 560 and a buffer 580.

The shift register 520 outputs a latch pulse to the latch 540.

The latch 540 temporally stores and outputs the data signal DATA.

The DAC 560 converts the data signal DATA having the digital form into the data voltage VD having the analog form using the gamma reference voltage VGREF and outputs the data voltage VD to the buffer 580.

The buffer 580 receives the data voltage VD from the DAC 560 and outputs the data voltage VD to the data lines DL. The buffer 580 may receive a first clock signal CLK1 to determine the driving times of the positive amplifiers and a second clock signal CLK2 to determine the driving times of the negative amplifiers. This way, the buffer 580 can independently control the driving time of the positive amplifiers and the driving time of the negative amplifiers.

Figure 7:
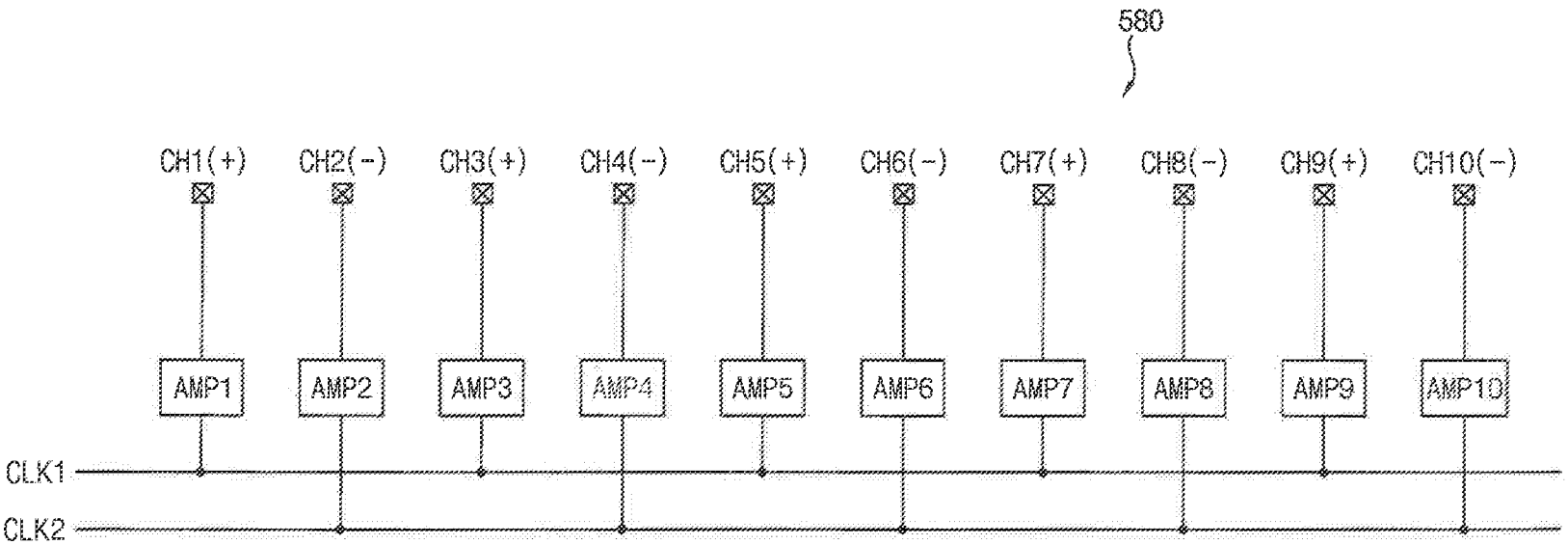
FIG. 7 is a diagram illustrating a buffer of FIG. 6 according to an exemplary embodiment of the present inventive concept.
Figure 8:
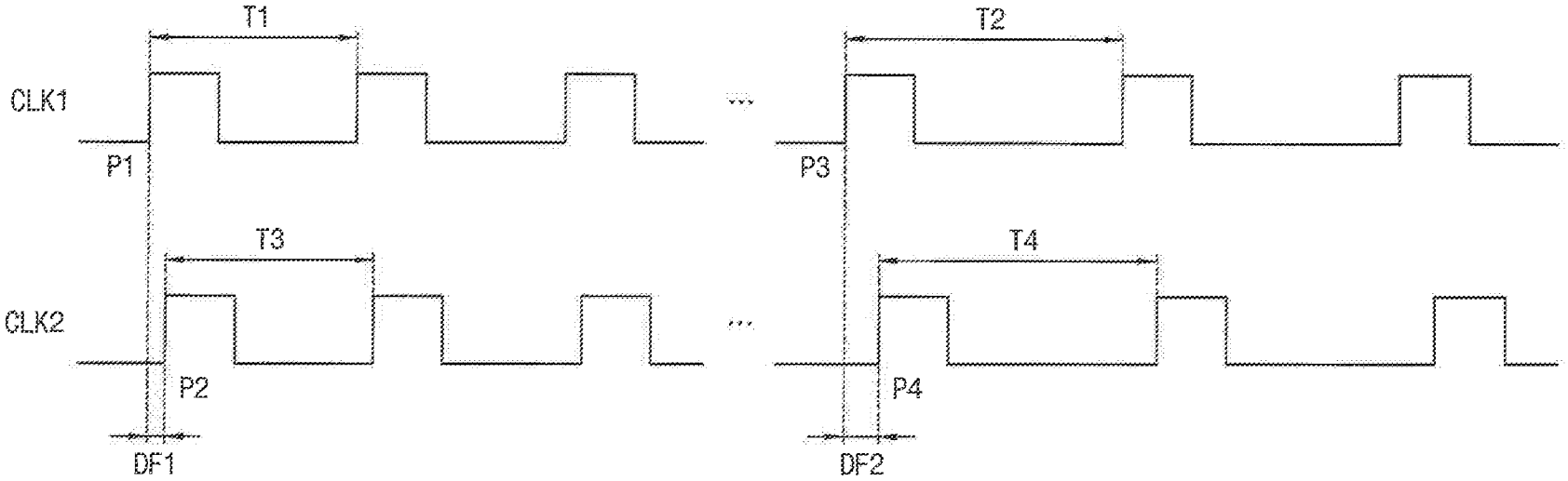
FIG. 8 is a timing diagram illustrating a first clock signal and a second clock signal of FIG. 7 according to an exemplary embodiment of the present inventive concept.

FIG. 7 is a diagram illustrating the buffer 580 of FIG. 6. FIG. 8 is a timing diagram illustrating the first clock signal CLK1 and the second clock signal CLK2 of FIG. 7.

Referring to FIGS. 1 to 8, the buffer 580 may include positive amplifiers AMP1, AMP3, AMP5, AMP7 and AMP9 for outputting positive data voltages to the data lines DL through channels CH1, CH3, CH5, CH7 and CH9 and negative amplifiers AMP2, AMP4, AMP6, AMP8 and AMP10 for outputting negative data voltages to the data lines DL through channels CH2, CH4, CH6, CH8 and CH10.

The display panel 100 is driven in an inversion driving method in every frame. When the polarity structure of the buffer 580 in a first frame is positive, the polarity structure of the buffer 580 in a second frame may be negative, which is opposite to the positive polarity structure of the buffer 580 of FIG. 7 in the first frame. To represent the polarity structures having both the positive and negative polarities, each of the amplifiers AMP1 to AMP10 may output both the positive data voltage and the negative data voltage. Alternatively, to represent the polarity structures having both the positive and negative polarities, the buffer 580 may further include a path selector to change connections between the amplifiers AMP1 to AMP10 and the channels CH1 to CH10. For example, the path selector may be a multiplexer.

The first clock signal CLK1 may control the driving timing of the positive amplifiers AMP1, AMP3, AMP5, AMP7 and AMP9. For example, the first positive amplifier AMP1 may output the positive data voltage based on a first pulse of the first clock signal CLK1. For example, the second positive amplifier AMP3 may output the positive data voltage based on a second pulse of the first clock signal CLK1. For example, the third positive amplifier AMP5 may output the positive data voltage based on a third pulse of the first clock signal CLK1.

A first period T1 of the first clock signal CLK1 to drive the positive amplifiers corresponding to the first area A1 may be less than a second period T2 of the first clock signal CLK1 to drive the positive amplifiers corresponding to the second area A2. The second period T2 of the first clock signal CLK1 in the second area A2, where the gate signal GS is delayed, is greater than the first period T1 of the first clock signal CLK1 in the first area A1 so that an applying time of the positive data voltage may be increased in the second area A2. Accordingly, the delay of the gate signal GS may be effectively compensated.

The second clock signal CLK2 may control the driving timing of the negative amplifiers AMP2, AMP4, AMP6, AMP8 and AMP10. For example, the first negative amplifier AMP2 may output the negative data voltage based on a first pulse of the second clock signal CLK2. For example, the second negative amplifier AMP4 may output the negative data voltage based on a second pulse of the second clock signal CLK2. For example, the third negative amplifier AMP6 may output the negative data voltage based on a third pulse of the second clock signal CLK2.

A third period T3 of the second clock signal CLK2 to drive the negative amplifiers corresponding to the first area A1 may be less than a fourth period T4 of the second clock signal CLK2 to drive the negative amplifiers corresponding to the second area A2. The fourth period T4 of the second clock signal CLK2 in the second area A2, where the gate signal GS is delayed, is greater than the third period T3 of the second clock signal CLK2 in the first area A1. In this case, an applying time of the negative data voltage may be increased in the second area A2. Accordingly, the delay of the gate signal GS may be effectively compensated.

In addition, the delay of the falling waveform of the gate signal GS is greater than the delay of the rising waveform of the gate signal GS so that the delay of the gate signal GS may affect the negative data voltage more than the positive data voltage. Thus, the fourth period T4 of the second clock signal CLK2 to drive the negative amplifiers corresponding to the second area A2 may be greater than the second period T2 of the first clock signal CLK1 to drive the positive amplifiers corresponding to the second area A2.

A first time point P1 of FIG. 8 may correspond to the first time point TP1 of FIG. 5A. A second time point P1 of FIG. 8 may correspond to the second time point TP2 of FIG. 5A. DF1 of FIG. 8 may be the time difference of the data output timing of the negative amplifiers corresponding to the first area A1 and the data output timing of the positive amplifiers corresponding to the first area A1.

A third time point P3 of FIG. 8 may correspond to the first time point TP1 of FIG. 5B. A fourth time point P4 of FIG. 8 may correspond to the second time point TP2 of FIG. 5B. DF2 of FIG. 8 may be the time difference of the data output timing of the negative amplifiers corresponding to the second area A2 and the data output timing of the positive amplifiers corresponding to the second area A2.

The delay of the gate signal GS in the second area A2 is greater than the delay of the gate signal GS in the first area A1 so that DF2 may be greater than DF1.

Although the outputting timing of the data voltage is controlled using the first clock signal CLK1 and the second clock signal CLK2 in the present exemplary embodiment, the present inventive concept is not limited thereto.

According to the present exemplary embodiment, the data voltage output timings of the positive output amplifier and the negative output amplifier of the data driver 500 are independently controlled so that the propagation delay of the gate signal GS according to the distance from the gate driver 300 may be compensated.

The delay of the gate signal GS is compensated so that the display quality of the display panel 100 may be enhanced.

Figure 9:
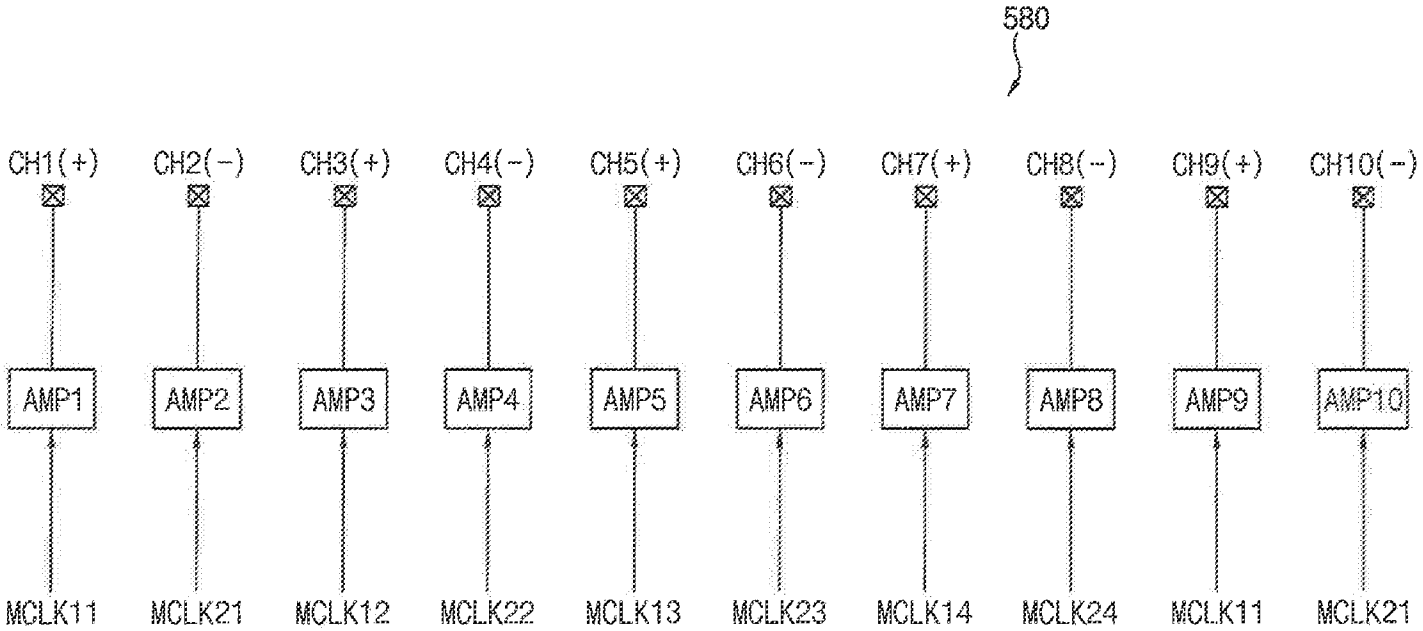
FIG. 9 is a diagram illustrating a buffer according to an exemplary embodiment of the present inventive concept.
Figure 10:
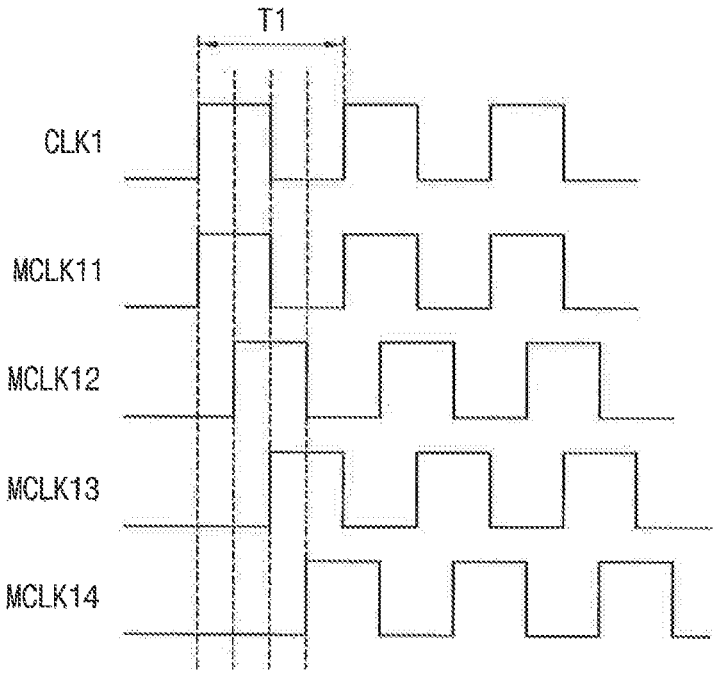
FIG. 10 is a timing diagram illustrating positive multi-phase clock signals of FIG. 9 according to an exemplary embodiment of the present inventive concept.
Figure 11:
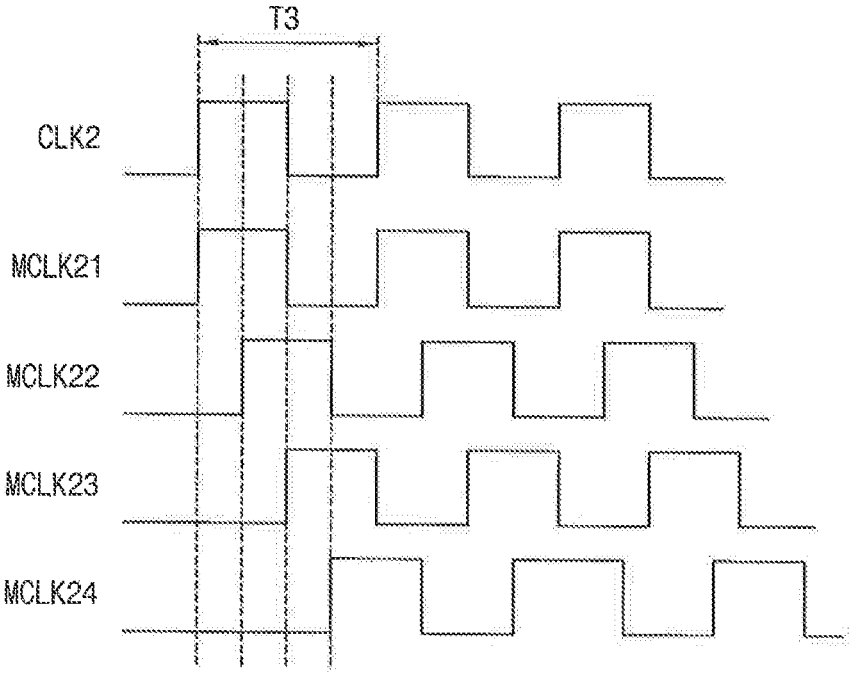
FIG. 11 is a timing diagram illustrating negative multi-phase clock signals of FIG. 9 according to an exemplary embodiment of the present inventive concept.

FIG. 9 is a diagram illustrating a buffer 580 according to an exemplary embodiment of the present inventive concept. FIG. 10 is a timing diagram illustrating positive multiphase clock signals of FIG. 9 according to an exemplary embodiment of the present inventive concept. FIG. 11 is a timing diagram illustrating negative multiphase clock signals of FIG. 9 according to an exemplary embodiment of the present inventive concept.

The display apparatus and the method of driving the display panel according to the present exemplary embodiment is substantially the same as the display apparatus and the method of driving the display panel of the previous exemplary embodiment explained referring to FIGS. 1 to 8 except for signals applied to the buffer. Thus, the same reference numerals may be used to refer to the same or like parts as those described in the previous exemplary embodiment of FIGS. 1 to 8 and any repetitive explanation concerning the already described elements may be omitted.

Referring to FIGS. 1 to 6 and 9 to 11, the data driver 500 may receive a first clock signal CLK1 to determine the driving timing of the positive amplifiers and a second clock signal CLK2 to determine the driving timing of the negative amplifiers. This way, the data driver 500 can independently control the driving timing of the positive amplifiers and the driving timing of the negative amplifiers.

The buffer 580 may include positive amplifiers AMP1, AMP3, AMP5, AMP7 and AMP9 for outputting positive data voltages to the data lines DL through channels CH1, CH3, CH5, CH7 and CH9 and negative amplifiers AMP2, AMP4, AMP6, AMP8 and AMP10 for outputting negative data voltages to the data lines DL through channels CH2, CH4, CH6, CH8 and CH10.

The data driver 500 may generate a plurality of positive multiphase clock signals MCLK11 to MCLK14 having different phases with each other using the first clock signal CLK1.

Although four positive multiphase clock signals having four different phases are illustrated in FIG. 10, the present inventive concept is not limited thereto.

The positive multiphase clock signals MCLK11 to MCLK14 may control the driving timings of the positive amplifiers AMP1, AMP3, AMP5, AMP7 and AMP9. For example, the first positive amplifier AMP1 may output the positive data voltage based on a first pulse of a first positive multiphase signal MCLK11. For example, the second positive amplifier AMP3 may output the positive data voltage based on a first pulse of a second positive multiphase signal MCLK12. For example, the third positive amplifier AMP5 may output the positive data voltage based on a first pulse of a third positive multiphase signal MCLK13. For example, the fourth positive amplifier AMP7 may output the positive data voltage based on a first pulse of a fourth positive multiphase signal MCLK14. For example, the fifth positive amplifier AMP9 may output the positive data voltage based on a second pulse of the first positive multiphase signal MCLK11.

A first period T1 of the first clock signal CLK1 to drive the positive amplifiers corresponding to the first area A1 may be less than a second period T2 of the first clock signal CLK1 to drive the positive amplifiers corresponding to the second area A2. The second period T2 of the first clock signal CLK1 in the second area A2, where the gate signal GS is delayed, is greater than the first period T1 of the first clock signal CLK1 in the first area A1 so that an applying time of the positive data voltage may be increased in the second area A2. Accordingly, the delay of the gate signal GS may be effectively compensated.

The data driver 500 may generate a plurality of negative multiphase clock signals MCLK21 to MCLK24 having different phases with each other using the second clock signal CLK2.

The negative multiphase clock signals MCLK21 to MCLK24 may control the driving timings of the negative amplifiers AMP2, AMP4, AMP6, AMP8 and AMP10 in the same manner the positive multiphase clock signals MCLK11 to MCLK14 are used to control the driving timings of the positive amplifiers AMP1, AMP3, AMP5, AMP7 and AMP9.

For example, the first negative amplifier AMP2 may output the negative data voltage based on a first pulse of a first negative multiphase signal MCLK21. For example, the second negative amplifier AMP4 may output the negative data voltage based on a first pulse of a second negative multiphase signal MCLK22. For example, the third negative amplifier AMP6 may output the negative data voltage based on a first pulse of a third negative multiphase signal MCLK23. For example, the fourth negative amplifier AMP8 may output the negative data voltage based on a first pulse of a fourth negative multiphase signal MCLK24. For example, the fifth negative amplifier AMP10 may output the negative data voltage based on a second pulse of the first negative multiphase signal MCLK21.

A third period T3 of the second clock signal CLK2 to drive the negative amplifiers corresponding to the first area A1 may be less than a fourth period T4 of the second clock signal CLK2 to drive the negative amplifiers corresponding to the second area A2. The fourth period T4 of the second clock signal CLK2 in the second area A2, where the gate signal GS is delayed, is greater than the third period T3 of the second clock signal CLK2 in the first area A1. Therefore, an applying time of the negative data voltage may be increased in the second area A2. Accordingly, the delay of the gate signal GS may be effectively compensated.

According to the present exemplary embodiment, the data voltage output timings of the positive output amplifier and the negative output amplifier of the data driver 500 are independently controlled so that the propagation delay of the gate signal GS according to the distance from the gate driver 300 may be compensated.

The delay of the gate signal GS is compensated so that the display quality of the display panel 100 may be enhanced.

Figure 12:
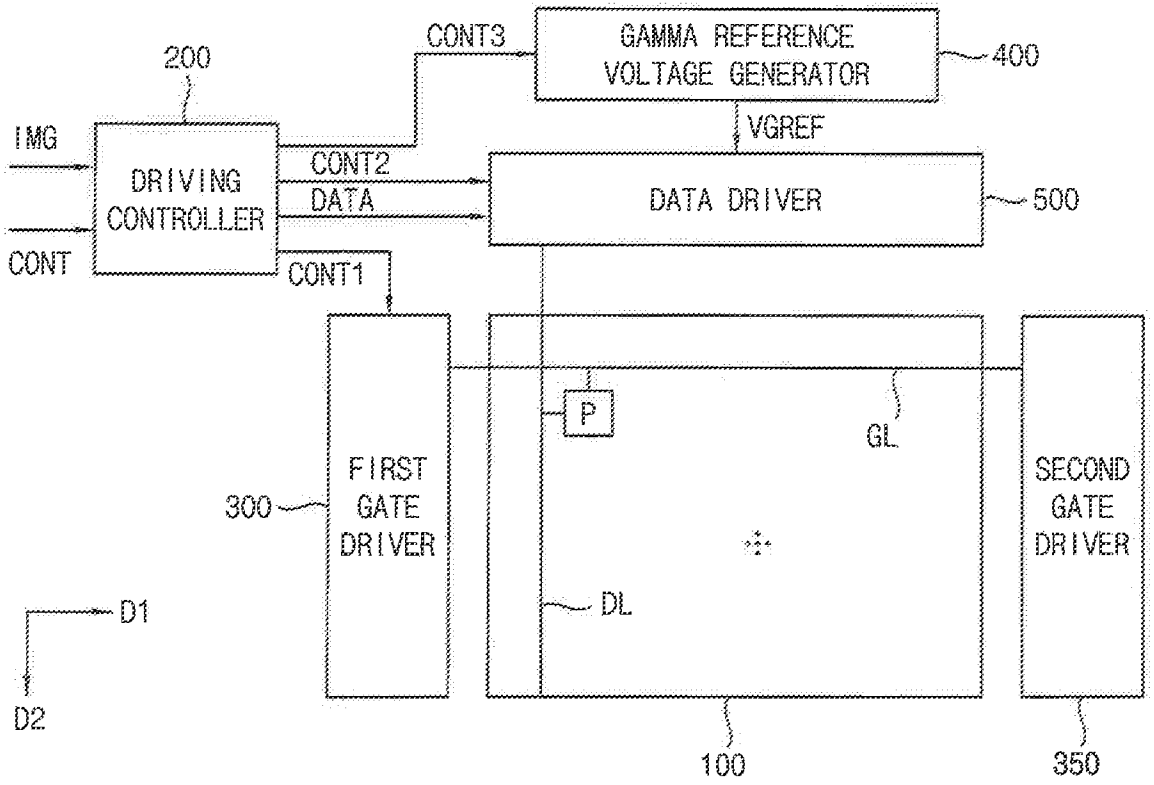
FIG. 12 is a block diagram illustrating a display apparatus according to an exemplary embodiment of the present inventive concept.
Figure 13:
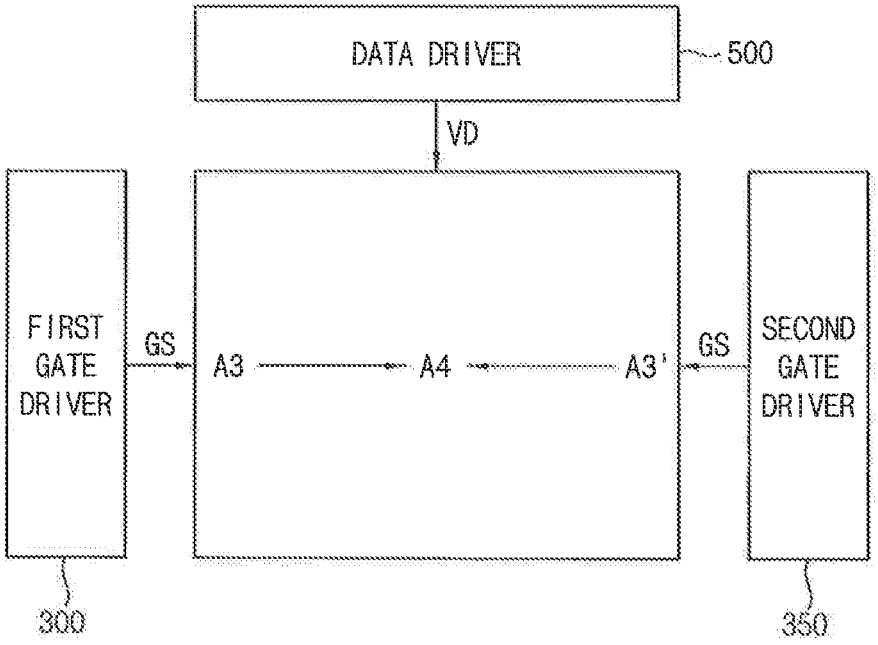
FIG. 13 is a diagram illustrating a first gate driver, a second gate driver, a data driver and a display panel of FIG. 12 according to an exemplary embodiment of the present inventive concept.
Figure 14A:
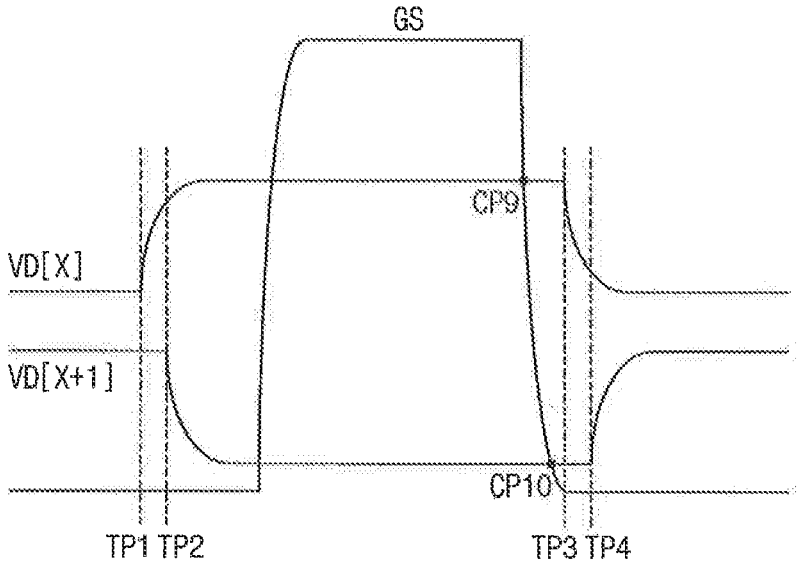
FIG. 14A is a waveform diagram illustrating a positive data voltage output from a positive amplifier corresponding to a third area of FIG. 13 and a negative data voltage output from a negative amplifier corresponding to the third area of FIG. 13 according to an exemplary embodiment of the present inventive concept.
Figure 14B:
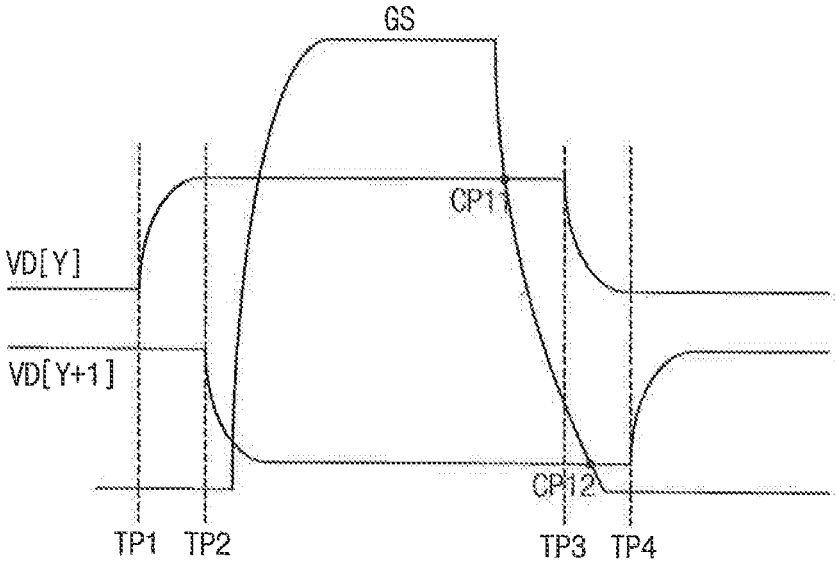
FIG. 14B is a waveform diagram illustrating a positive data voltage output from a positive amplifier corresponding to a fourth area of FIG. 13 and a negative data voltage output from a negative amplifier corresponding to the fourth area of FIG. 13 according to an exemplary embodiment of the present inventive concept.

FIG. 12 is a block diagram illustrating a display apparatus according to an exemplary embodiment of the present inventive concept. FIG. 13 is a diagram illustrating a first gate driver, a second gate driver, a data driver and a display panel of FIG. 12 according to an exemplary embodiment of the present inventive concept. FIG. 14A is a waveform diagram illustrating a positive data voltage output from a positive amplifier corresponding to a third area of FIG. 13 and a negative data voltage output from a negative amplifier corresponding to the third area of FIG. 13 according to an exemplary embodiment of the present inventive concept. FIG. 14B is a waveform diagram illustrating a positive data voltage output from a positive amplifier corresponding to a fourth area of FIG. 13 and a negative data voltage output from a negative amplifier corresponding to the fourth area of FIG. 13 according to an exemplary embodiment of the present inventive concept.

The display apparatus and the method of driving the display panel according to the present exemplary embodiment is substantially the same as the display apparatus and the method of driving the display panel of the previous exemplary embodiment explained referring to FIGS. 1 to 8 except that the display apparatus includes first and second gate drivers. Thus, the same reference numerals may be used to refer to the same or like parts as those described in the previous exemplary embodiment of FIGS. 1 to 8 and any repetitive explanation concerning the already described elements may be omitted.

Referring to FIGS. 12 to 14B, the display apparatus includes a display panel 100 and a display panel driver. The display panel driver includes a driving controller 200, a first gate driver 300, a second gate driver 350, a gamma reference voltage generator 400 and a data driver 500.

The first and second gate drivers 300 and 350 output the gate signal GS to the display panel 100. The data driver 500 outputs the data voltage VD to the display panel 100.

In the present exemplary embodiment, the first gate driver 300 is disposed adjacent to a first side of the display panel 100. The second gate driver 350 is disposed adjacent to a second side of the display panel 100 facing the first side of the display panel 100. The display panel 100 includes a third area (e.g., A3 or A3' in FIG. 13) close to the first gate driver 300 or the second gate driver 350 and a fourth area A4 far from the first gate driver 300 and the second gate driver 350. A waveform of the gate signal GS outputted from the first gate driver 300 and the second gate driver 350 may be delayed in the fourth area A4 compared to the third area (e.g., A3 or A3' in FIG. 13).

In the present exemplary embodiment of FIGS. 14A and 14B, the positive amplifier and the negative amplifier may output the data voltage non-simultaneously. In the present exemplary embodiment, the driving timing of the positive amplifiers and the driving timing of the negative amplifiers may also be independently controlled. For example, the data output timing of a first negative amplifier may be later than the data output timing of a first positive amplifier adjacent to the first negative amplifier.

Referring to FIG. 14A, the gate signal GS may not be delayed in the third area A3 or A3' close to the first gate driver 300 or the second gate driver 350. For example, VD[X] represents the data voltage outputted from the positive amplifier corresponding to the third area (e.g., A3 or A3' in FIG. 13) and VD[X+1] represents the data voltage outputted from the negative amplifier corresponding to the third area (e.g., A3 or A3' in FIG. 13. The negative amplifier corresponding to the third area may be adjacent to the positive amplifier corresponding to the third area. In a first time point TP1, the positive data voltage VD[X] may rise toward a corresponding target grayscale. In a second time point TP2 delayed with respect to the first time point TP1, the negative data voltage VD[X+1] may fall toward a corresponding target grayscale. In a third time point TP3, the positive data voltage VD[X] may rise or fall toward a corresponding target grayscale of a next horizontal line. In a fourth time point TP4 delayed with respect to the third time point TP3, the negative data voltage VD[X+1] may rise or fall toward a corresponding target grayscale of the next horizontal line.

In FIG. 14A, the gate signal GS may not be delayed, and thus, the gate signal GS is overlapped with the positive data voltage VD[X] at a ninth crossing point CP9. Thus, a positive pixel to which the positive data voltage VD[X] is applied may represent a desired target grayscale. The gate signal GS is overlapped with the delayed negative data voltage VD[X+1] at a tenth crossing point CP10. Thus, a negative pixel to which the negative data voltage VD[X+1] is applied may represent a desired target grayscale.

Referring to FIG. 14B, the gate signal GS may be delayed in the fourth area A4 far from the first gate driver 300 and the second gate driver 350. For example, a failing waveform of the gate signal GS may be delayed more than a rising waveform of the gate signal GS. For example, VD[Y] represents the data voltage outputted from the positive amplifier corresponding to the fourth area A4 and VD[Y+1] represents the data voltage outputted from the negative amplifier corresponding to the fourth area A4. The negative amplifier corresponding to the fourth area A4 may be adjacent to the positive amplifier corresponding to the fourth area A4. In a first time point TP1, the positive data voltage VD[Y] may rise toward a corresponding target grayscale. In a second time point TP2 delayed with respect to the first time point TP1, the negative data voltage VD[Y+1] may fall toward a corresponding target grayscale. In a third time point TP3, the positive data voltage VD[Y] may rise or fall toward a corresponding target grayscale of a next horizontal line. In a fourth time point TP4 delayed with respect to the third time point TP3, the negative data voltage VD[Y+1] may rise or fall toward a corresponding target grayscale of the next horizontal line. A difference between the second time point TP2 and the first time point TP1 in FIG. 14B may be greater than a difference between the second time point TP2 and the first time point TP1 in FIG. 14A since the delay of the gate signal GS in the fourth area A4 is greater than the delay of the gate signal GS in the third area (e.g. A3 or A3' in FIG. 13).

In FIG. 14B, the gate signal GS may be delayed. For example, the falling waveform of the gate signal GS may be delayed more than the rising waveform of the gate signal GS. The gate signal GS is overlapped with the positive data voltage VD[Y] at an eleventh crossing point CP11. Thus, a positive pixel to which the positive data voltage VD[Y] is applied may represent a desired target grayscale. The gate signal GS is overlapped with the delayed negative data voltage VD[+1] at a twelfth crossing point CP12. The falling timing and the rising timing of the delayed negative data voltage VD[Y+1] is delayed with respect to the falling timing and the rising timing of the positive data voltage VD[Y] to compensate for the delay of the gate signal GS so that a negative pixel to which the negative data voltage VD[Y+1] is applied may represent a desired target grayscale.

According to the present exemplary embodiment, the data voltage output timings of the positive output amplifier and the negative output amplifier of the data driver 500 are independently controlled so that the propagation delay of the gate signal GS according to the distance from the gate driver 300 may be compensated.

The delay of the gate signal GS is compensated so that the display quality of the display panel 100 may be enhanced.

According to the exemplary embodiments of the display apparatus and the method of driving the display panel described herein, the data voltage output timings of the positive output amplifier and the negative output amplifier are independently controlled so that the display quality of the display panel may be enhanced.

While the present inventive concept has been particularly shown and described with reference to exemplary embodiments thereof, it will be apparent to those of ordinary skill in the art that various changes in form and detail may be made thereto without departing from the spirit and scope of the present inventive concept as defined by the following claims.

What is claimed is:

1. A display apparatus, comprising:

a display panel configured to display an image;

a first gate driver configured to output gate signals to the display panel; and a data driver comprising positive amplifiers configured to output positive data voltages to the display panel and negative amplifiers configured to output negative data voltages to the display panel, wherein a driving timing of the positive amplifiers and a driving timing of the negative amplifiers are independently controlled, wherein the display panel includes a first area having a first distance from the first gate driver and a second area having a second distance from the first gate driver, wherein the second distance is greater than the first distance, wherein the data driver comprises a first positive amplifier configured to output a first positive data voltage to the second area and a first negative amplifier configured to output a first negative data voltage to the second area, wherein the first negative amplifier is adjacent to the first positive amplifier, and wherein a data output timing of the first negative amplifier is later than a data output timing of the first positive amplifier.

2. The display apparatus of claim 1, wherein the data driver further comprises a second positive amplifier configured to output a second positive data voltage to the first area and a second negative amplifier configured to output a second negative data voltage to the first area, wherein the second negative amplifier is adjacent to the second positive amplifier, and wherein a time difference of the data output timing of the first negative amplifier and the data output timing of the first positive amplifier is greater than a time difference of a data output timing of the second negative amplifier and a data output timing of the second positive amplifier.

3. The display apparatus of claim 1, wherein a first clock signal is applied to the positive amplifiers, and wherein a second clock signal is applied to the negative amplifiers.

4. The display apparatus of claim 3, wherein a first period of the first clock signal to drive the positive amplifiers corresponding to the first area is less than a second period of the first clock signal to drive the positive amplifiers corresponding to the second area.

5. The display apparatus of claim 4, wherein a third period of the second clock signal to drive the negative amplifiers corresponding to the first area is less than a fourth period of the second clock signal to drive the negative amplifiers corresponding to the second area.

6. The display apparatus of claim 5, wherein the fourth period of the second clock signal to drive the negative amplifiers corresponding to the second area is greater than the second period of the first clock signal to drive the positive amplifiers corresponding to the second area.

7. The display apparatus of claim 1, wherein a plurality of positive multiphase clock signals having phases different with each other is generated based on a first clock signal and the positive multiphase clock signals are sequentially applied to the positive amplifiers, and wherein a plurality of negative multiphase clock signals having phases different with each other is generated based on a second clock signal and the negative multiphase clock signals are sequentially applied to the negative amplifiers.

8. The display apparatus of claim 1, wherein the first gate driver is disposed adjacent to a first side of the display panel, wherein the first area is adjacent to the first side of the display panel, and wherein the second area is adjacent to a second side of the display panel facing the first side of the display panel.

9. The display apparatus of claim 1, further comprising a second gate driver configured to output the gate signals to the display panel, wherein the first gate driver is disposed adjacent to a first side of the display panel and the second gate driver is disposed adjacent to a second side of the display panel facing the first side of the display panel, wherein the first area is adjacent to the first side of the display panel or the second side of the display panel, and wherein the second area corresponds to a central portion of the display panel.

10. A method of driving a display panel, the method comprising:

outputting gate signals to the display panel;

outputting positive data voltages to the display panel using positive amplifiers; and outputting negative data voltages to the display panel using negative amplifiers, wherein a driving timing of the positive amplifiers and a driving timing of the negative amplifiers are independently controlled, wherein the display panel includes a first area having a first distance from a gate driver and a second area having a second distance from the gate driver, wherein the second distance is greater than the first distance, wherein a data driver comprises a first positive amplifier configured to output a first positive data voltage to the second area and a first negative amplifier configured to output a first negative data voltage to the second area, wherein the first negative amplifier is adjacent to the first positive amplifier, and wherein a data output timing of the first negative amplifier is later than a data output timing of the first positive amplifier.

11. The method of claim 10, wherein the data driver further comprises a second positive amplifier configured to output a second positive data voltage to the first area and a second negative amplifier configured to output a second negative data voltage to the first area, wherein the second negative amplifier is adjacent to the second positive amplifier, and wherein a time difference of the data output timing of the first negative amplifier and the data output timing of the first positive amplifier is greater than a time difference of a data output timing of the second negative amplifier and a data output timing of the second positive amplifier.

12. The method of claim 10, wherein a first clock signal is applied to the positive amplifiers, and wherein a second clock signal is applied to the negative amplifiers.

13. The method of claim 12, wherein a first period of the first clock signal to drive the positive amplifiers corresponding to the first area is less than a second period of the first clock signal to drive the positive amplifiers corresponding to the second area.

14. The method of claim 13, wherein a third period of the second clock signal to drive the negative amplifiers corresponding to the first area is less than a fourth period of the second clock signal to drive the negative amplifiers corresponding to the second area.

15. The method of claim 14, wherein the fourth period of the second clock signal to drive the negative amplifiers corresponding to the second area is greater than the second period of the first clock signal to drive the positive amplifiers corresponding to the second area.

16. A display apparatus, comprising:

a display panel configured to display an image;

a gate driver configured to output gate signals to the display panel; and a data driver comprising a first amplifier configured to output a first data voltage to the display panel and a second amplifier configured to output a second data voltage to the display panel, wherein a driving time of the first amplifier and a driving time of the second amplifier are independently controlled, wherein a plurality of pixels are arranged in a horizontal row in the display panel, and a gate signal applied to a pixel farthest from the gate driver is delayed with respect to a gate signal applied to a pixel closest to the gate driver.

17. The display apparatus of claim 16, wherein a falling time and a rising time of the second data voltage is delayed with respect to a falling time and a rising time of the first data voltage such that the first gate signal does not overlap the falling time of the first data voltage and the rising time of the second data voltage.

* * * * *